US006040059A

United States Patent [19]

Birkner et al.

[11] Patent Number: 6,040,059

[45] Date of Patent: Mar. 21, 2000

[54] COMPONENT MADE OF AN ALUMINIUM SILICON CAST ALLOY

[75] Inventors: Stefan Birkner, Neuhaus; Ernst Strian, Kunreuth; Markus Kreibiehl, Weisendorf, all of Germany

[73] Assignee: LuK GmbH & Co., Germany

[21] Appl. No.: 09/189,195

[22] Filed: Nov. 9, 1998

[30] Foreign Application Priority Data

Nov. 18, 1997 [DE] Germany ..... 197 51 002

[51] Int. Cl.[7] ..... B32B 9/00

[52] U.S. Cl. ..... 428/469; 428/450; 428/472.2; 192/30 R

[58] Field of Search ..... 428/469, 472.2, 428/450; 192/30 R, 107 M

[56] References Cited

U.S. PATENT DOCUMENTS

| | | | |
|---|---|---|---|
| 4,098,619 | 7/1978 | Franz . | |
| 4,177,299 | 12/1979 | Severus et al. | 427/287 |
| 4,902,353 | 2/1990 | Rooy et al. . | |
| 4,945,004 | 7/1990 | Sprintschnik et al. | 428/469 |
| 4,995,917 | 2/1991 | Dagustany et al. | 148/3 |
| 5,114,825 | 5/1992 | Takizawa et al. | 430/159 |
| 5,494,540 | 2/1996 | Ochi et al. . | |
| 5,618,358 | 4/1997 | Davisson et al. | 148/549 |

FOREIGN PATENT DOCUMENTS

| | | |
|---|---|---|
| 0185192 | 6/1986 | European Pat. Off. . |
| 1169682 | 5/1964 | Germany . |
| 3148183 | 6/1983 | Germany . |
| 4110145 | 11/1991 | Germany . |
| 7243010 | 6/1995 | Japan . |

OTHER PUBLICATIONS

Aluminium–Taschenbuch, Aluminum–Verlag GmbH, Dusseldorf 1974, 13 Aufl., pp. 333–342, 378–379, 693–696.

K. Taguchi, "Production . . . Anodizing", Patent Abstracts of Japan, vol. 15, No. 167, Apr. 26, 1991, C–827, Abstract No. 3–36245.

S. Furuya, "Manufacture . . . Acid Bath", Patent Absracts of Japan vol. 18, No. 97, Feb. 17, 1994, C–1167, Abstract No. 5–295494.

*Primary Examiner*—Timothy M. Speer
*Assistant Examiner*—Bryant Young
*Attorney, Agent, or Firm*—Bierman, Muserlian and Lucas

[57] ABSTRACT

A component (17) made of an aluminum silicon cast alloy whose surface is at least partly subjected to an anodic treatment to produce an oxide layer, which component comprises, prior to the anodic treatment, a surface-proximate deformation zone (4) configured as a homogeneous zone in which the silicon is uniformly distributed in the α-mixed crystal (1) and due to this homogeneous mixing of aluminum and silicon, the differing electric conductivities of the original structural constituents (α-mixed crystal, eutectic) are replaced by a uniform electric conductivity so that uniform oxide layers can grow during the anodizing process.

5 Claims, 3 Drawing Sheets

COMPONENT MADE OF AN ALUMINIUM SILICON CAST ALLOY

FIELD OF THE INVENTION

A component made of an aluminium silicon cast alloy whose surface is at least partly subjected to an anodic treatment to produce an oxide layer.

BACKGROUND OF THE INVENTION

Anodic oxidation in which the components are connected as anodes and, together with an opposite electrode, are exposed to d.c. voltage, has been known for a long time (Praktische Galvanotechnik, Eugen G. Leuze-Verlag, Saulgaul/Württ., $4^{th}$ Edition, 1984). Already during the stage of its formation, the anodically precipitating oxygen combines with the aluminium surface and the structure and thickness of the thus formed layer depends primarily on the duration of the process and the current density. By this process, the colorless oxide film which always forms on an aluminium surface in an atmosphere of air, is thickened to a dimension of up to 100 $\mu$m so that a high corrosion resistance against oxidizing media and a high resistance against wear mechanisms is established.

A drawback of this, however, is that, in the case of aluminium alloys of the aluminium silicon type, the differing microstructural constituents with their differing electric conductivity lead to the formation of an oxide layer of non-uniform thickness which can be disadvantageous for certain technical uses.

OBJECTS OF THE INVENTION

It is therefore an object of the invention to assure as uniform a layer thickness as possible in an $Al_2O_3$ layer produced on aluminium silicon alloys by anodic oxidation.

This and other objects and advantages of the invention will become obvious from the following detailed description.

SUMMARY OF THE INVENTION

The invention achieves the above objects by the fact that the surface to be oxidized by anodizing comprises a homogeneous surface-proximate deformation zone in which an eutectic network of silicon and aluminum and a primary aluminium mixed crystal are uniformly and thoroughly mixed with each other.

By the application of a force component acting tangentially to the surface during processing, a very homogeneous mixing of aluminium and silicon is obtained, i.e., solidified lamellar silicon is comminuted and embedded in the $\alpha$-mixed crystal so that a deformation zone mixed with eutectic and $\alpha$-mixed crystal is formed in the direction of processing whose electric conductivity is more or less uniform compared to that of the different microstructural constituents. To put it differently, a kind of grease layer is produced by a plastic flow of the uppermost regions of the material whose electric conductivity measured across the geometric extent is more or less uniform, so that the thickness of the $Al_2O_3$ layer formed by the anodic treatment is also uniform across the geometric extent i. e., a homogeneous layer and a homogenous layer distribution with a high profile bearing length ratio are obtained. The small silicon crystals are uniformly embedded in the anodized layer. Advantageous features of the invention will now be described.

According to one proposition of the invention, the deformation zone has a thickness of approximately 10 $\mu$m. This guarantees that structural homogenization takes place to a sufficient depth and thus assures the growth of a uniform $Al_2O_3$ layer. One third or up to half of this artificially produced oxide layer grows inwards into the material or, to put it differently, two thirds or up to half of this layer grows towards the outside.

According to a further proposition of the invention, the component is made of an Al Si or Al Si Mg cast alloy. Based on their eutectic composition, aluminium cast alloys acquire a finely distributed compact cast structure and good castability. Al Si cast alloys are the most important aluminium cast alloys. They are suitable for pressure die-casting, gravity die-casting and sand casting. For example, Al Si12, due to its good flow properties, is preferentially used for thin-walled pressure and liquid tight castings. Al Si Mg alloys are core hardenable, sand castings are weldable and they possess a high fatigue strength after core hardening. As hypoeutectic cast alloys, they are used in the chemical industry and in automobile and ship construction.

According to another feature of the invention, the aluminium silicon cast alloy is subjected to grain size reduction or refinement. As well known, this involves the addition of titanium and boron in the form of an intermediate alloy, e.g. Al Ti5, Al Ti5 B1, Al Ti3 B1 and the addition of strontium or sodium. By grain size reduction, the size of the grain of the $\alpha$-mixed crystal is reduced, while refining endows silicon with a granular structure. The reduced grain size and the globulitic grain shape lead to an improvement of the grease effect because the sufficiently rounded silicon can be better mixed into the base material.

According to a final feature of the invention, the component forms a part of a clutch release system for automobiles and comprises seal slide surfaces for sliding seals in the hydraulic region.

In such parts for a hydraulic clutch release system, uniform oxide layers are an absolute requirement because, otherwise, sealing is inadequate and fluid can flow out under the sealing lip i. e., higher leakage which can have a negative effect on the operation of the entire system is encountered.

BRIEF DESCRIPTION OF THE DRAWINGS

The invention will now be described more closely with reference to the following example of embodiment illustrated in the drawings.

DETAILED DESCRIPTION OF THE DRAWINGS

Figure 1:
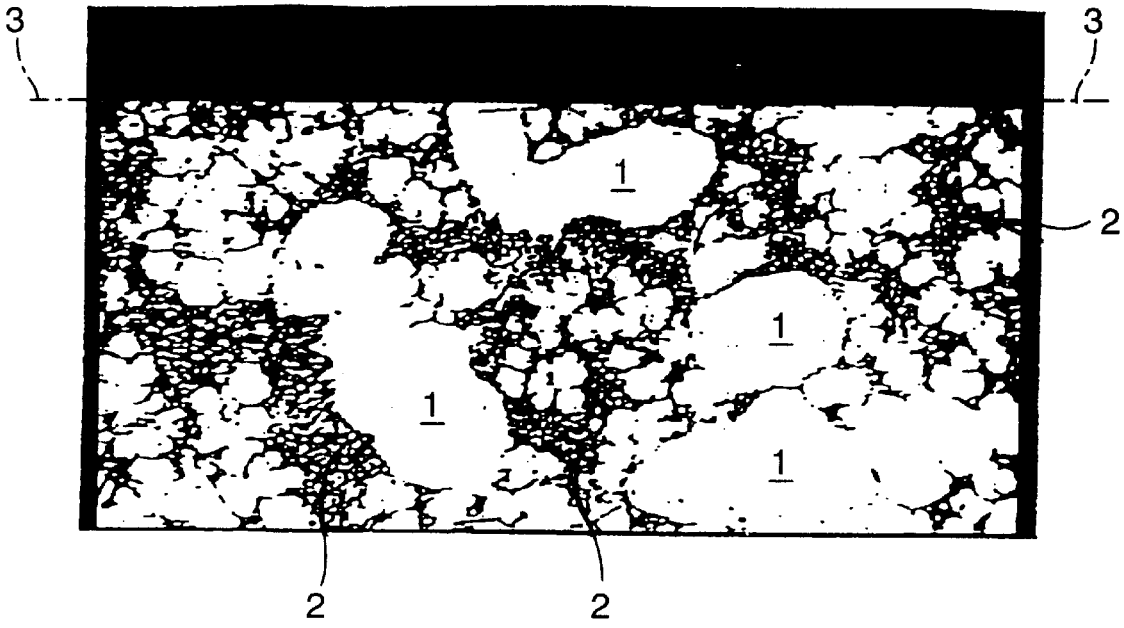
FIG. 1 is a longitudinal metallographic section of an Al Si alloy showing the microstructure of a surface obtained by normal processing.

FIG. 1 shows the longitudinal section of a cast alloy GD Al Si10 containing approximately 9.0 to 11.0% Si. In the micrograph, the $\alpha$-mixed crystals identified at 1 can be clearly seen. They are surrounded by the eutectic identified at 2 i.e., by a fine crystalline mixture of $\alpha$-mixed crystals 1 and silicon. The eutectic 2 is represented in the micrograph as a coherent black surface which is interrupted by small white islands and surrounded by clearly discernible large $\alpha$-mixed crystals 1, that is to say, the silicon is shown in black. The longitudinal metallographic section shows that, depending on the geometric position, the surface 3 can be comprised of an α-mixed crystal 1 or of the eutectic 2. But the α-mixed crystal 1 and the eutectic 2 possess different electric conductivity i.e., the electric conductivity of the α-mixed crystal is higher than that of the eutectic 2. For this reason, anodic oxidation in an electrolyte also results in different growth speeds of the $Al_2O_3$ layer which grows faster in the region of an α-mixed crystal 1 than in the region of the eutectic 2.

Figure 2:
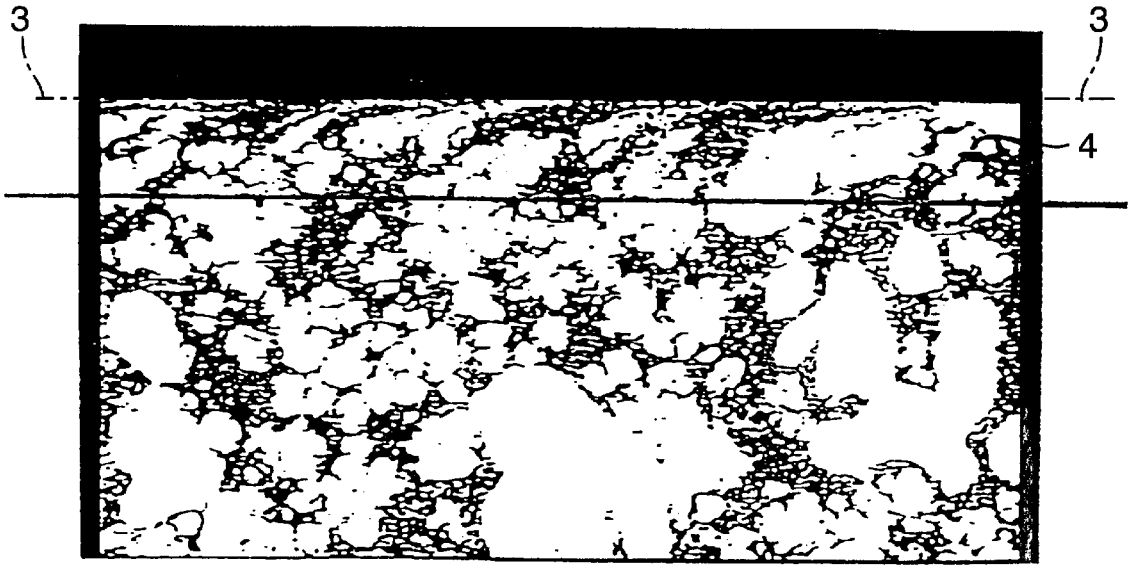
FIG. 2 is a longitudinal metallographic section of the alloy of FIG. 1 with a deformation zone of the invention.

In the micrograph of FIG. 2, the cast alloy is shown prior to the anodic treatment for reinforcing the natural $Al_2O_3$ layer in a 1300-fold enlargement. It can be seen that in the surface-proximate deformation zone 4, by this is meant the zone extending from the surface up to the uninfluenced microstructure, the microstructural constituents are much more homogeneously distributed. Due to this homogeneous distribution of the microstructural constituents, a uniformly growing $Al_2O_3$ layer is also obtained by anodization. The extent and the configuration of the deformation zone depends on parameters like feed rate, cutting speed, cutting force, lubrication conditions and knife geometry.

Figure 3:
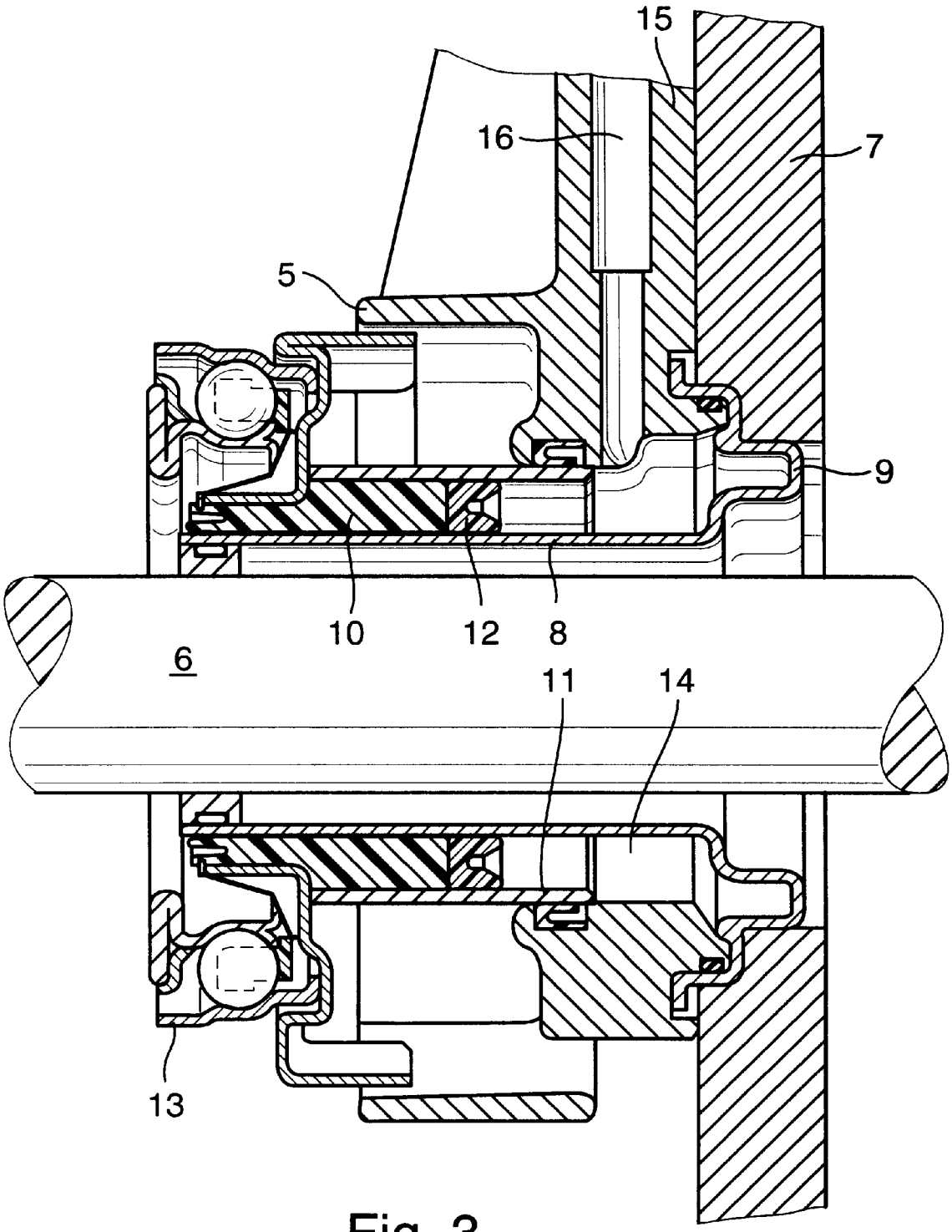
FIG. 3 is a longitudinal cross-section through a hydraulic release device.

FIG. 3 shows a hydraulically actuatable release device for a friction clutch of an automotive vehicle. The device comprises a pressure housing 5 arranged concentrically around a gear drive shaft 6 and fixed on the gearbox casing 7. A guide sleeve 8 is disposed in the pressure housing 5 so as to be radially spaced from a central bore and is rotationally and positionally fixed on the pressure housing 5 by a gearbox-proximate annular flange 9. An annular piston 10 is guided on the guide sleeve 8 while being outwardly surrounded by an intermediate bushing 11 which bears sealingly against a bore wall of the pressure housing 5. The piston 10 is provided with a seal 12 which bears on one side against the guide sleeve 8 and on the other side against the intermediate bushing 11. On the end of the piston 10 remote from the annular flange 9, there is arranged a release bearing 13 which, in the installed state, bears against a friction clutch. A supply of pressure medium to a pressure chamber 14, defined essentially by the guide sleeve 8, the annular flange 9 and the piston 10, is assured by a pressure connector 15 through whose longitudinal bore 16 pressure medium for the actuation of the friction clutch can be transported.

Figure 4:
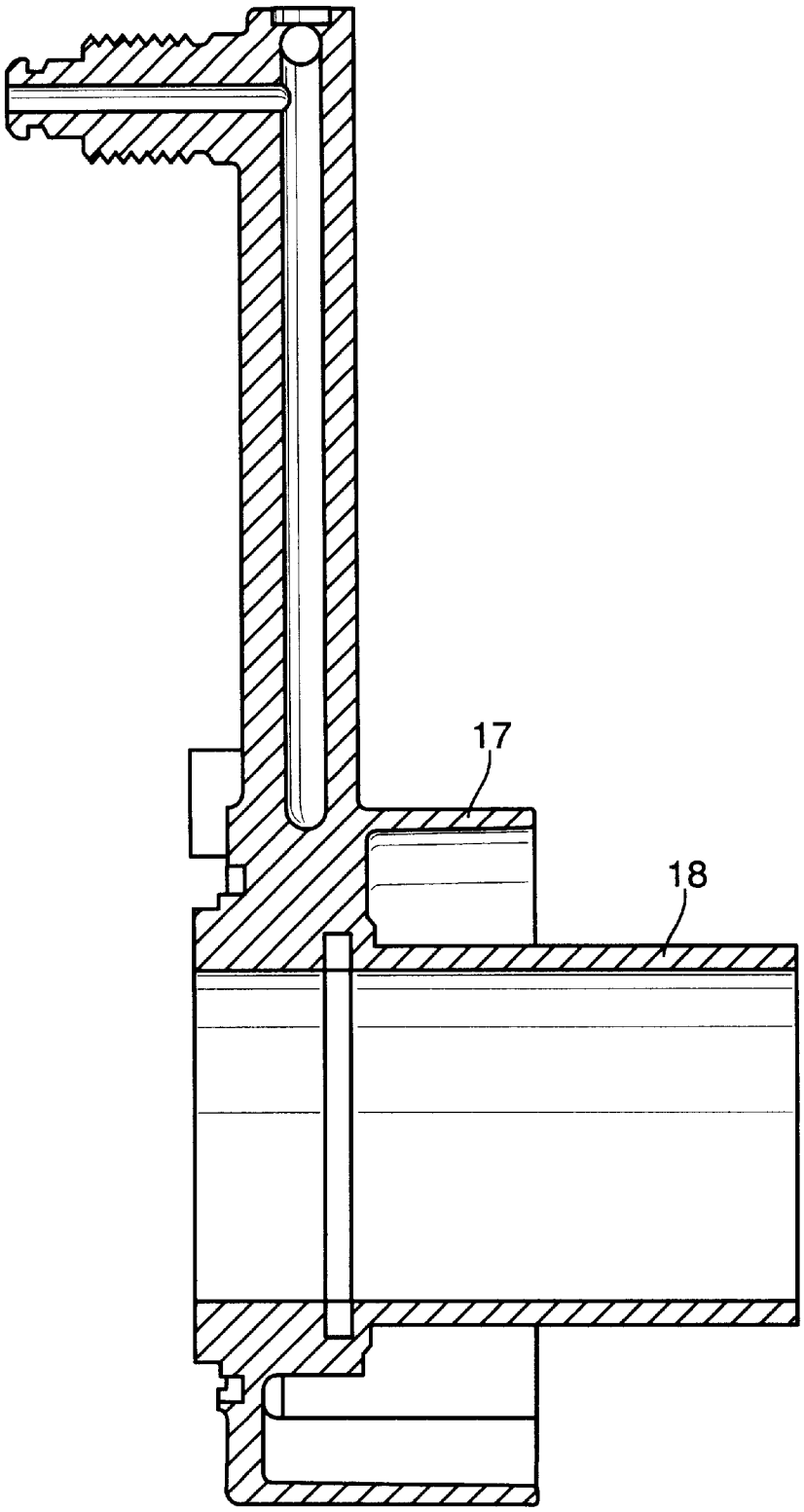
FIG. 4 is a longitudinal cross-section through a pressure housing of a hydraulic release device.

FIG. 4 shows a longitudinal cross-section of a pressure housing 17 which in contrast to the pressure housing 5 shown in FIG. 3, is formed integrally with a guide sleeve 18 so that the intermediate bushing 11 of FIG. 3 can be omitted when the element 17 is used in the release device shown in FIG. 3. The piston 10 is arranged with its seal 12 in the reception bore of the guide sleeve 18 and bears with the sealing lips of the seal 12 both against the guide sleeve 18 and against the guide sleeve 8.

The pressure housing 17 is made by a pressure die-casting method out of the alloy Al Si10 Mg and is subjected to a mechanical finishing treatment after solidification to fulfil the geometric requirements of roundness and diameter. Since the inner surface of the guide sleeve 18 of the pressure housing 17 forms a countersurface for the seal 12 of the piston 10, said inner surface is provided with the surface-proximate deformation zone of the invention described above in which the silicon is uniformly distributed in the α-mixed crystal 1. This assures that the guide sleeve 18 comprises an $Al_2O_3$ layer of uniform thickness along the entire path of axial displacement of the piston 10 so that perfect sealing is guaranteed. Compared to a surface not treated in accordance to the invention, the profile bearing length ratio as defined in DIN 4762 is raised from 15% to 35% which means that the more uniform the structure of the $Al_2O_3$ layer is, the larger is the profile bearing length ratio.

Oxidation of the surface of the component is effected in a known manner by the direct current sulfuric acid method (GS) in which the following process parameters may be implemented:

Composition

Sulfuric acid $H_2SO_4$ (1.84 g/cm$^3$) 280 g/l

Aluminium sulfate $Al_2(SO_4)_3 \times 18\ H_2O$ 25 g/l

Working Conditions

| | |
|---|---|
| Density at 20° C. | 1.18 to 1.29 g/cm$^3$ |
| Temperature | 18 to 20° C. |
| Current density | 1.5 A/dm$^2$ |
| Voltage | 10 to 15 V |
| Connection of the workpieces | anodic |
| Layer growth | 1 μm in 2 to 3 min |
| Movement | by compressed air |
| Cathode | aluminium cathode |
| Surface ratio of anode to cathode | 1:1 |

What we claim is:

1. An aluminum silicon cast alloy component with at least part of its surface is subjected to anodizing to form an oxide layer with a surface proximate deformation zone configured as a homogeneous zone in which an eutectic network of silicon and aluminum and a primary aluminum mixed crystal are uniformly and thoroughly mixed with each others.

2. A component of claim 1 wherein the deformation zone (4) has a thickness of approximately 10 μm.

3. A component of claim 1 wherein the aluminum silicon cast alloy is an Al Si or Al Si Mg alloy.

4. A component of claim 1 wherein the aluminum silicon cast alloy is subjected to grain size reduction or refinement.

5. A clutch release system for automobiles containing a component of claim 1 forming seal slide surfaces for sliding seals in the hydraulic region.

* * * * *